United States Patent [19]

Hull et al.

[11] 4,422,358

[45] Dec. 27, 1983

[54] APPARATUS FOR CUTTING A CONTINUOUS NARROW STRIP INTO SHORT SECTIONS

[75] Inventors: Harvey C. Hull, Kettering; Robert W. Henz, Sr., Dayton, both of Ohio

[73] Assignee: The Standard Register Company, Dayton, Ohio

[21] Appl. No.: 250,230

[22] Filed: Apr. 6, 1981

[51] Int. Cl.[3] ..... B26D 1/38

[52] U.S. Cl. ..... 83/356.3; 83/349; 83/566; 241/243

[58] Field of Search ..... 83/356.3, 349, 566, 83/567; 241/243

[56] References Cited

U.S. PATENT DOCUMENTS

| | | | |
|---|---|---|---|
| 1,676,048 | 7/1928 | Philbrick | 83/349 |
| 2,399,529 | 4/1946 | Willits | 83/349 X |
| 3,244,049 | 4/1966 | Smith et al. | 83/355 |
| 3,264,921 | 8/1966 | Nystrand | 83/349 X |
| 3,359,843 | 12/1967 | Mead | 83/349 |
| 3,401,585 | 9/1968 | Schmermund | 83/341 |
| 3,760,673 | 9/1973 | Peterson, Jr. | 83/349 |
| 3,779,123 | 12/1973 | Chafee | 83/349 X |
| 3,799,020 | 3/1974 | Hoelmer | 83/349 |
| 3,871,257 | 3/1975 | Schmermund | 83/349 X |
| 3,898,900 | 8/1975 | Schmermund | 83/349 |
| 3,899,947 | 8/1975 | Faltin . | |
| 4,055,309 | 10/1977 | Fleming et al. . | |
| 4,114,491 | 9/1978 | Hashimoto et al. . | |
| 4,119,003 | 10/1978 | Corse . | |
| 4,226,372 | 10/1980 | Wigand | 83/356.3 |

*Primary Examiner*—Donald R. Schran

*Attorney, Agent, or Firm*—Jacox & Meckstroth

[57] ABSTRACT

Apparatus for cutting a continuous narrow strip into short sections. The apparatus comprises a rotatable yoke which has attached thereto a plurality of blades, each of which has an edge provided with a row of teeth. The yoke is adjacent a stationary blade which has an edge provided with a row of teeth. The teeth of the blades which are attached to the yoke and the teeth of the stationary blade mesh as the yoke rotates.

A guide member directs a continuous strip generally vertically downwardly to a position between the yoke and the stationary blade. Thus, as the yoke rotates, the strip is cut into short sections which fall downwardly from the yoke and from the stationary blade.

4 Claims, 6 Drawing Figures

APPARATUS FOR CUTTING A CONTINUOUS NARROW STRIP INTO SHORT SECTIONS

BACKGROUND OF THE INVENTION

In several types of business forms producing machine and processes, a continuous moving web of paper or paper-like material is moved by means of marginal rows of pin feed holes. After the web is printed, the marginal portions of the web are removed as the web travels. The marginal portions thus become continuous narrow strips which are considered as scrap and must be disposed of.

Conventionally, the continuous narrow strips are diverted into a waste basket or the like. The strips form loops and other formations of various configurations and sizes and at various angles within the waste basket. Such loops and formations of the narrow continuous strip inefficiently occupy space within the waste basket as there is much unused spaced between strip loops and formations within the waste basket. Thus, a waste basket is effectively filled quickly, even though a relatively short length of the narrow strip occupies the waste basket.

In order to more efficiently fill a waste basket various methods and devices have been created to sever a continuous narrow strip into short sections prior to disposal in a waste basket. However, most of such known devices create a tearing action as severance occurs. Such tearing action produces fine strands of paper which extend in various directions from the short sections and occupy space and prevent other short sections from occupying the space which is occupied by the strands. Therefore, such tearing action creates short sections, but such short sections do not efficiently fill a waste basket.

Furthermore, known devices which are employed in business forms producing machines for severing a continuous narrow strip into short sections tend to cause snagging between the device and the continuous web. Thus, web jams or paper jams are caused in the business form production machine.

Also, known devices which sever a continuous narrow strip into short sections are relatively slow in operation and may retard the operation of the entire business forms production machine.

It is therefore an object of this invention to provide apparatus which operates in combination with or as a part of a business forms production machine and which receives a moving narrow continuous strip which is severed from a margin of a web and which cuts the moving narrow continuous strip into short sections.

Another object of this invention is to provide such apparatus which is capable of high speed operation.

Another object of this invention is to provide such apparatus which cleanly cuts the narrow strip into short sections so that there are no extending strands.

Another object of this invention is to provide such apparatus which is easily installed or mounted as a part of or in combination with a business forms producing machine.

Other objects and advantages of this invention reside in the construction of parts, the combination thereof, the method of production, and the mode of operation, as will become more apparent from the following description.

BRIEF SUMMARY OF THE INVENTION

The apparatus of this invention for cutting a continuous strip into short sections comprises a plurality of moving blades which have cutting edges which move in an annular path. Adjacent the path of travel of the moving blades is a stationary blade. The moving blades and the stationary blade have teeth which mesh as the moving blades travel.

A continuous strip is guided generally vertically downwardly to a position between the stationary blade and the moving blades. The teeth of the moving blades and the teeth of the stationary blades have cutting edges which meshingly cooperate to provide a scissors type of cutting action upon the strip, and the continuous strip is cut into relatively short sections.

DETAILED DESCRIPTION OF THE INVENTION

Figure 1:
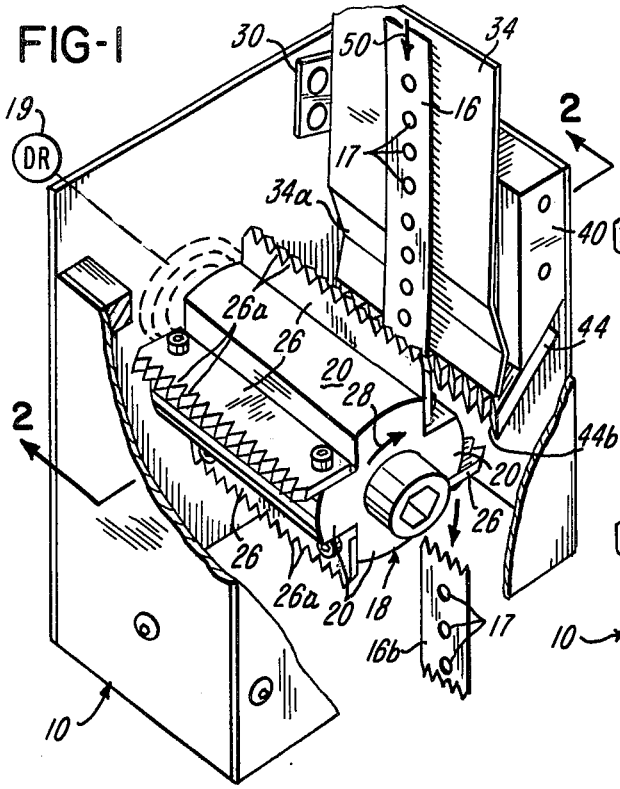
FIG. 1 is a perspective view, with parts broken away and shown in section, of apparatus of this invention for cutting a narrow continuous strip into short sections.

Apparatus of this invention for cutting a continuous narrow strip into relatively short sections comprises a housing 10 which may be attached to or may be a part of a machine which produces business forms from a continuous moving web. Ordinarily, the continuous web has marginal portions, each of which is provided with a row of holes which receive pin feed elements for movement of the continuous web. The machine, not shown, severs each marginal portion of the web to produce a continuous narrow strip, such as a strip 16, provided with feed holes 17, illustrated in the figures of the drawing.

Figure 5:
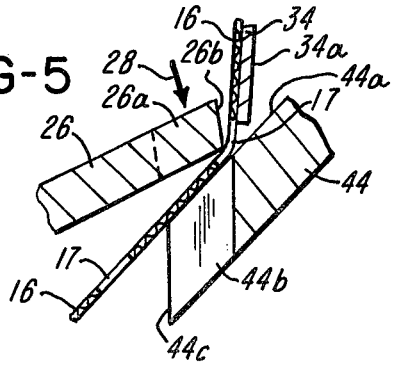
FIG. 5 is a fragmentary diagrammatic view, drawn on a much larger scale than the preceding figures and illustrating a succeeding stage in a cutting operation.
Figure 6:
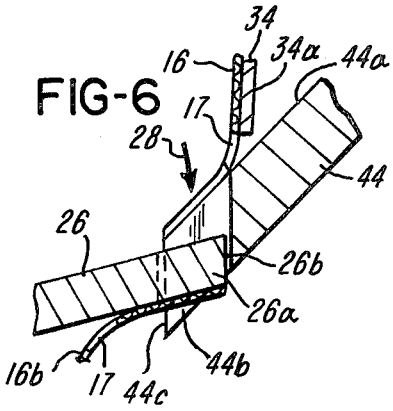
FIG. 6 is a fragmentary diagrammatic view similar to FIG. 5 and illustrating a succeeding stage in a cutting operation by the apparatus of this invention.

The apparatus of this invention includes a yoke 18, rotatably supported by the housing 10 in any suitable manner. The yoke 18 is rotated by any suitable means, herein illustrated diagrammatically as drive means 19. The yoke 18 rotates in a clockwise direction, as illustrated by an arrow 28. The yoke 18 is shown as having a plurality of lobes 20. Each of the lobes 20 has a blade 26 attached thereto, for movement therewith. Each blade 26 has a row of teeth **26*a* along the edge thereof. Each of the teeth 26*a* has a protruding cutting edge 26*b*, which slopes angularly outwardly in a direction opposite to the direction of rotation of the yoke 18. As illustrated in FIGS. 5 and 6, the protruding cutting edge 26*b* is angular with respect to the plane of the supporting blade 26**.

Attached to the housing 10 therewithin by means of a bracket 30 is a guide member 34, which is generally vertical and has the major portion thereof suspended resiliently downwardly from the bracket 30. The guide member 34 has a lower end portion 34*a* which is angularly offset with respect to the major part of the guide member 34. The lower end portion 34*a* is adjacent the yoke 18.

Also, attached to the housing 10 therewithin is a bracket 40 to which is attached a stationary blade 44. The stationary blade 44 has an upper surface 44*a* which slopes downwardly. The stationary blade 44 has a row of teeth 44*b* along the lower edge thereof. Each of the teeth 44*b* has a protruding cutting edge 44*c* which is substantially vertical, as best illustrated in FIGS. 5 and 6. Thus, the protruding cutting edge 44*c* is angular with respect to the upper surface 44*a* of the stationary blade 44.

OPERATION

Figure 3:
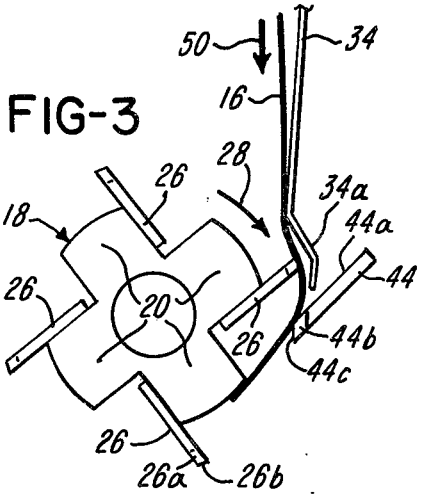
FIG. 3 is a diagrammatic view illustrating the entrance of an end of a continuous strip into the apparatus of this invention in an initial stage of a cutting operation.
Figure 4:
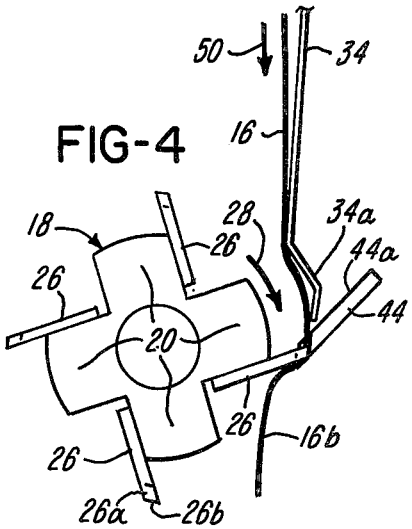
FIG. 4 is a diagrammatic view similar to FIG. 3 and showing the apparatus in a succeeding stage in a cutting operation.

As stated above, the apparatus of this invention may be a part of or attached to a machine which produces business forms from a continuous web. As the continuous web travels, the marginal portion or strip 16, which has the feed holes 17, is slit therefrom. After slitting thereof, the narrow marginal strip 16 moves downwardly, as illustrated by an arrow 50. The narrow strip 16 is guided in its downward travel by the generally vertical guide member 34, as illustrated in FIGS. 3 and 4. The lower end of the strip 16 travels downwardly to a position between one of the lobes 20 of the yoke 18 and the lower end portion 34*a* of the guide member 34. The upper surface 44*a* of the stationary blade 44 as it slopes downwardly directs the lower portion of the strip 16 to move downwardly to a position between the stationary teeth 44*b* and the moving teeth 26*a*. The lower end of the narrow strip 16 thus becomes positioned between a moving blade 26 and the stationary blade 44. As the yoke 18 continues to rotate, the teeth 26*a* of the moving blade 26 force the lower part of the narrow strip 16 toward the lower end portion 34*a* of the guide member 34, as illustrated in FIG. 3.

Depending upon the thickness and other characteristics of the strip 16, the teeth 26*a* of the blade 26 may force the lower end portion of the strip 16 against the lower end portion 34*a* of the guide member 34. When this occurs, the resiliency of the lower end portion 34*a* of the guide member 34 permits movement of the lower end portion 34*a* in a direction from the yoke 18. Thus, the lower end portion 34*a* of the guide member 34 controls the movement of the strip 16 to the cutting teeth 26*a* and 44*b*.

The teeth 26*a* of the moving blade 26 force the lower end portion of the strip 16 into engagement with the teeth 44*b* of the stationary blade 44, as illustrated in FIGS. 3, 4, 5. As the moving teeth 26*a* travel with respect to the stationary teeth 44*b*, there is a scissors type of cutting action between the moving teeth 26*a*, and the stationary teeth 44*b*, as illustrated in FIGS. 5 and 6. As the scissors type of cutting action occurs, the cutting edge of the moving teeth 26*a* moves to a position substantially parallel to the cutting edge of the stationary teeth 44*b*. At the instant of cutting action, the cutting edges 26*b* and 44*c* of the cutting teeth 26*a* and 44*b*, respectively, are substantially vertical and substantially parallel to the lower portion of the narrow strip 16. Therefore, the apparatus of this invention provides clean cutting action, as distinguished from tearing action.

Figure 2:
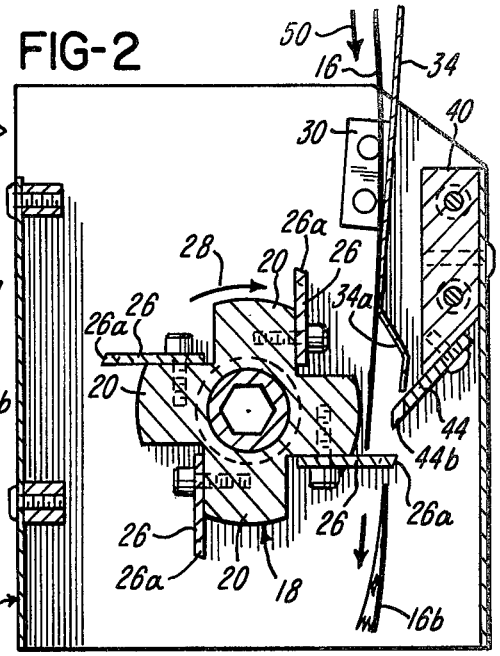
FIG. 2 is a sectional view taken substantially on line 2—2 of FIG. 1.

As the yoke 18 rotates, as illustrated, the spacing between the moving teeth 26*a* is such, that relatively short sections, such as a section 16*b*, are cut from the strip 16, and the sections fall downwardly, as illustrated in FIG. 2.

Although the preferred embodiment of the apparatus of this invention has been described, it will be understood that within the purview of this invention various changes may be made in the form, details, proportion and arrangement of parts, the combination thereof, and the mode of operation, which generally stated consist in apparatus within the scope of the appended claims.

The invention having thus been described, the following is claimed:

1. Apparatus for cutting a continuously moving continuous strip into short sections, comprising:

a housing, a yoke supported within the housing and rotatable about a generally horizontal axis, the axis of rotation of the yoke being at a given elevational level within the housing, the yoke having a plurality of radially extending lobes, a plurality of first blades, there being a first blade attached to each of the lobes of the yoke and movable with rotation of the yoke, each of the first blades having a substantially horizontal row of teeth, each of the teeth having a protruding cutting edge, a stationary blade positioned within the housing adjacent the yoke, the upper surface of the stationary blade having a portion above the axis of rotation of the yoke and sloping downwardly toward the yoke, the stationary blade having a lower end portion closely adjacent the yoke and at substantially the same elevational level within the housing as the axis of rotation of the yoke, the stationary blade having a horizontal row of teeth as the lower end portion thereof, each of the teeth of the stationary blade having a cutting edge which is substantially vertical, an elongate guide member oriented substantially vertically within the housing and supported at a position substantially above the yoke and the stationary blade, the elongate guide member having a resilient portion extending downwardly from the position of support thereof, the elongate guide member having a lower end portion which is positioned generally above the lower end portion of the stationary blade and closely adjacent thereto, the yoke rotating in a direction so that the first blades travel downwardly toward the stationary blade and the teeth of the first blades mesh with the teeth of the stationary blade as the yoke rotates, a continuous strip traveling downwardly within the housing and being guided by the elongate guide member to a position adjacent the lower end portion of the stationary blade, the first blades engaging a part of the continuous strip and urging said part of the continuous strip into engagement with the lower end portion of the guide member as the yoke rotates, the strip being directed by the guide member to a position between the teeth of the stationary blade and the teeth of a first blade and being severed by the teeth of the first blade and the teeth of the stationary blade as the yoke rotates.

2. The apparatus of claim 1 in which the elongate guide member has an offset portion adjacent the lower end thereof.

3. The apparatus fo claim 1 in which the cutting edge of the teeth of the first blades is substantially vertical as the teeth of the first blades mesh with the teeth of the stationary blade.

4. Apparatus for cutting a continuously moving continuous strip into short sections, comprising:

support structure, a yoke supported upon the support structure and rotatable about a generally horizontal axis, the axis of rotation of the yoke being at a given elevational level with respect to the support structure, a plurality of first blades attached to the yoke and movable with rotation thereof, each of the first blades having a row of teeth, each of the teeth having a protruding cutting edge, a stationary blade supported by the support structure adjacent the yoke, the upper surface of the stationary blade sloping downwardly toward the yoke, the stationary blade having a lower end portion closely adjacent the yoke and at substantially the same elevational level as the axis of rotation of the yoke, the stationary blade having a horizontal row of teeth at the lower end portion thereof, each of the teeth of the stationary blade having a protruding cutting edge which is substantially vertical, a substantially vertically extending elongate guide member supported by the support structure at a position substantially above the yoke and the stationary blade, the elongate guide member having a resilient portion extending downwardly from the position of support thereof, the elongate guide member having a lower end portion which is positioned generally above the lower end of the stationary blade, the teeth of the first blades traveling downwardly toward the stationary blade and meshing with the teeth of the stationary blade as the yoke rotates, the cutting edge of the teeth of the first blades being substantially vertical as the teeth of the first blades mesh with the teeth of the stationary blade, a continuous strip traveling downwardly with respect to the support structure and being guided by the elongate guide member to a position adjacent the lower end portion of the elongate guide member, the strip being directed by the guide member to a position between the teeth of the stationary blade and the teeth of a first blade and being severed by the teeth of the first blade and the teeth of the stationary blade as the yoke rotates.

* * * * *